United States Patent [19]

Takeda

[11] Patent Number: 4,986,700

[45] Date of Patent: Jan. 22, 1991

[54] BUOYANT FORCE CONTROL APPARATUS FOR SCUBA DIVING

[76] Inventor: Yukio Takeda, No. 16-2-610 Akabane-Minami 1-chome, Kita-ku, Tokyo, Japan

[21] Appl. No.: 506,261

[22] Filed: Apr. 9, 1990

[30] Foreign Application Priority Data

Apr. 10, 1989 [JP] Japan ..... 1-90388

[51] Int. Cl.[5] ..... B63C 11/02

[52] U.S. Cl. ..... 405/186; 128/201.26; 128/202.14

[58] Field of Search ..... 405/186, 185; 441/86; 128/200.29, 201.11, 201.26, 201.27, 201.28, 202.14, 861

[56] References Cited

U.S. PATENT DOCUMENTS

| | | | |
|---|---|---|---|
| 728,476 | 5/1903 | Langer | 128/201.26 |
| 2,316,101 | 4/1943 | Norred | 405/186 X |
| 3,138,155 | 6/1964 | Bould | 405/186 X |
| 3,536,071 | 10/1970 | Ferrando | 128/202.14 |
| 3,866,253 | 2/1975 | Sinks et al. | 128/202.14 |
| 4,176,418 | 12/1979 | Scott | 441/96 |
| 4,227,521 | 10/1980 | Hart et al. | 128/202.14 |

*Primary Examiner*—Dennis L. Taylor

*Attorney, Agent, or Firm*—Fleit, Jacobson, Cohn, Price, Holman & Stern

[57] ABSTRACT

A buoyant force control apparatus for scuba diving is used being installed on a diver's suit. Air supply to an air chamber formed within the suit is done, by pushing operations of opening and closing the air supply valve, from an air tank. Alternately, the driver holds the air breathe-in port or mouth piece between teeth while pushing a valve shaft slidably installed in an air supply valve. Air exhaustion from the air chamber is carried out by pulling one of pull strings attached to the first and second exhaust valves, respectively secured to both half portions of the front part of the diver's suit at different levels so as to separate them from each other.

3 Claims, 2 Drawing Sheets

BUOYANT FORCE CONTROL APPARATUS FOR SCUBA DIVING

BACKGROUND OF THE INVENTION (1) Technical Field

The present invention relates to a buoyant force control apparatus for scuba diving, in particular, to buoyant force control apparatus for scuba diving having a simple construction without an oral inflator hose and a valve box, so that even beginners can manipulate without erroneous operations and safety of the apparatus is additionally increased.

(2) Prior Art

According to the conventional buoyant force control apparatus for scuba diving, they are classified to that, for example, of a jacket type, a life jacket (hang-on-neck) type which are worn on a diver's suit of the diver, and of a shoulder-belt type attached to the diver's wear.

For example, FIG. 4 depicts an example of the jacket type vest and a conventional buoyant force control apparatus applied to the vest of the diver.

In detail, according to the prior art above, the vest 32 has an inner air chamber 31 and has an oral inflator hose 33 consisting of a large diameter flexible hose of about 50 mm dia. The upper opening port of the oral inflator hose 33 is communicated with the inner air chamber 31 at a position of the shoulder of a half part of a front portion of the vest 32. The lower opening port of the oral inflator hose 33 is connected to the valve box 34 through connection of the hose 33 and an end of a main tube 35 of the valve box 34 as shown in FIG. 5. To the valve box 34, a mouth piece 36 for sending or supplying air to the air chamber 31 is secured so as to communicate with the main tube 35. A valve rod 38 for closing and opening the tube portion or passage 37 communicating with the mouth piece 36 from the main tube 35 is inserted into the main tube. The valve rod 38 has a button 39 for supplying and exhausting air fixed thereto. A lower opening port of a middle-pressure hose 41 connected to an air tank or reservoir 40 through an upper end of the hose 41 are connected to an air supply tube portion or passage 42 leading to the main tube 35.

It is apparent that an air supply button 44 is provided at an outer end of a valve rod 43 for closing and opening the air supply tube passage 42. At the position of other shoulder of another half part of the vest front portion, there is an overpressure prevention valve 45 which is led to the air chamber 31. A pull string 46 for releasing the overpressure prevention valve 45 is inserted through a guide tube 47 secured to the front face portion of the vest 32 so as to be suspended along the front face portion and has a grip ball 48 fixed to a depending end of the pull string 46 so as to make pulling of the pull string easy.

When the diver wearing the conventional buoyant force control apparatus wants to control buoyant force as he is under water or on the water and to supply air to the air chamber 31 of the vest 32, first he pushes the air supply button 44 to release the closed condition of the air supply tube passage 42 by means of the valve rod 43 in order to make the air supply tube passage 42 led to the main tube passage 35. As a result, a predetermined volume of air in the air tank 40 is supplied to the air chamber 31 of the vest 32 through the air supply tube passage 42 of the valve box 34, a main tube passage 35 and the oral inflator hose 33, and then a pressed condition of the air supply button 44 is released and the air supply tube passage 42 is closed by the valve rod 43 returned to its original position so as to shut a communication between the air supply tube passage 42 and the main tube passage 35 stopping air supply. Air leak is prevented or the air supply and exhaust button 39 is pushed in order to release a closed condition of the mouth piece tube passage 37 using the valve rod 38, the mouth piece tube passage is led to the main tube passage 35. A mouth of the driver is applied to the mouth piece 36 and air is blown to supply a predetermined volume of air to the air chamber 31 through the main tube passage 35 and the oral inflator hose 33. Then the pressed condition of the air supply and exhaust button 39 is released and the valve 38 closes the mouth piece tube passage 37 in order to shut down it from the main tube passage 35, stopping air supply, as well as preventing air leak.

On the contrary, in order to exhaust air from the air chamber 31, first the valve box 34 is held in a hand of the driver or the user as shown in FIG. 5, the hand is raised high and kept at its high position, the air supply and exhaust button 39 is pressed to release the closed condition of the mouth piece tube passage 37 leading it to the main tube passage 35 and the predetermined volume of air is escaped or exhausted through the mouth piece 36. Then, a pressed condition of the air supply and exhaust button 39 is released, the valve rod 38 closes the mouth piece tube passage 37 to shut down it from the main tube passage 35 in order to stop further flowing-out of air-through the mouth piece tube passage 37. Alternately, the pull string 46 for releasing the tube passage of the overpressure prevention valve 45 is pulled to exhaust the predetermined volume of air and the pull string 46 is set free to close the tube passage stopping additional air flowing.

However, according to the conventional buoyant force control apparatus for scuba diving, the driver or user must carry out the air supply and exhaust operation or button pushing and releasing manipulation by only his fingers while the hand holds the valve box 34 and rises high as shown in FIG. 5, so that in particular beginners of the conventional buoyant force control apparatus or inexperienced diver using the apparatus apt to do erroneous operations or manipulations dangerously. Only the upper opening or port of the oral inflator hose 33 is fixed to an upper portion of the vest 32 and the lower portion of the oral inflator hose 33 is not attached to the vest 32 since the driver must rise the valve box 34 high and operates it at this raised condition, so that the oral inflator hose 33 with the valve box 34 is apt to move to the back of the vest 32 while the user swims or moves under water. In consequence, when he wants to use the valve box 34 in an emergency, he frequently cannot find or touch the valve box 34. Additionally a long hose or complicated hose system is installed on the diver's vest hindering him from free movement and a large bag is need to store the diving applicance. These above have been problems or risks to be solved in the field.

SUMMARY OF THE INVENTION

The present invention provides a buoyant force control apparatus for scuba diving having an air supply rubber tube attached to the front face of a wear of the diver, an air supply valve provided with a valve opening and closing means operated by a manipulation or pushing operation, and a pair of first and second exhaust valves.

It is the first purpose of the present invention to provide a buoyant force control apparatus for scuba diving of a simple construction and not having an oral inflator and a valve box, such as in the conventional apparatus.

It is the second purpose of the present invention to provide a buoyant force control apparatus for scuba diving of a simple construction and so that an operation of the simple apparatus is done without any risk of erroneous manipulations.

It is the third purpose of the present invention to provide a buoyant force control apparatus for scuba diving, in which apparatus the fundamental operation of air supplying and air exhausting are differed to each other so as to eliminate any erroneous operations and increase the safety of the apparatus.

It is the fourth purpose of the present invention to provide a buoyant force control apparatus for scuba diving, which can be reliably manipulated without missing the device to be manipulated even while swimming under water.

It is the fifth purpose of the present invention to provide a buoyant force control apparatus for scuba diving of a simple and neat construction, being carried in a small bag conveniently.

The purposes above and other purposes and novel characteristics of the present invention will be more apparent by reading the following explanation with reference to the accompanying drawings. However, respective figures attached must be used exclusively to explain the preferred embodiment of the present invention and mustn't be used to restrict the limit of the present invention.

DETAILED EXPLANATION OF THE INVENTION

Figure 1:
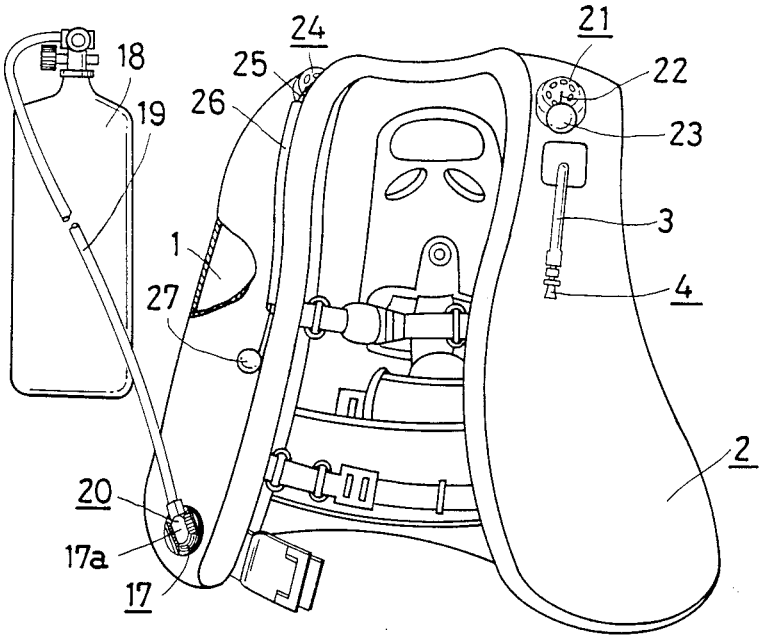
FIG. 1 is a perspective view of a preferred embodiment of the buoyant force control apparatus for scuba diving according to the present invention, a part of the apparatus being broken away.

It is noted that the buoyant force control apparatus for scuba diving of the present invention can be applied as known in the field to diver's wears of jacket type, hang-on-neck (life jacket) type, or shoulder belt type. In the following explanation of the present invention, the case in which the buoyant force control apparatus for scuba diving according to the present invention is applied to the wear of jacket type, which is typical one, is employed.

On a part of the breast on the front half of the wear 2 provided with an inner air chamber 1, an upper opening port of an air supply rubber tube 3 of a diameter of preferably about 20 mm is communicated with the air chamber 1 and secured to the part, an air supply valve 4 is firmly inserted to a lower opening port of the air supply rubber tube 3, and the air supply valve 4 is communicated with an air supply tube passage 5 of the air supply rubber tube 3.

Figure 2:
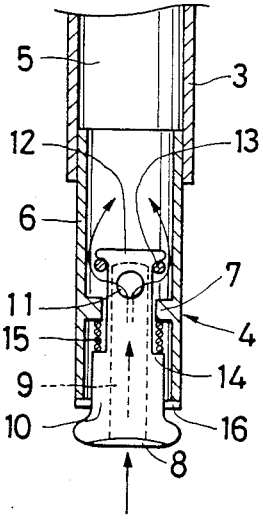
FIG. 2 and FIG. 3 are large sectional views showing operative conditions of the air supply valve installed in the apparatus according to the present invention.
Figure 3:
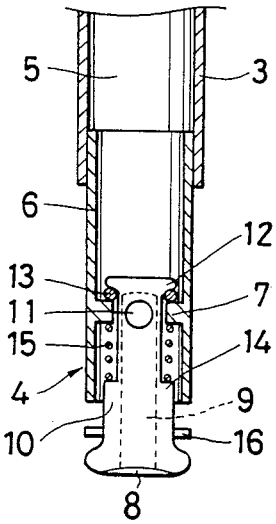
Figure 4:
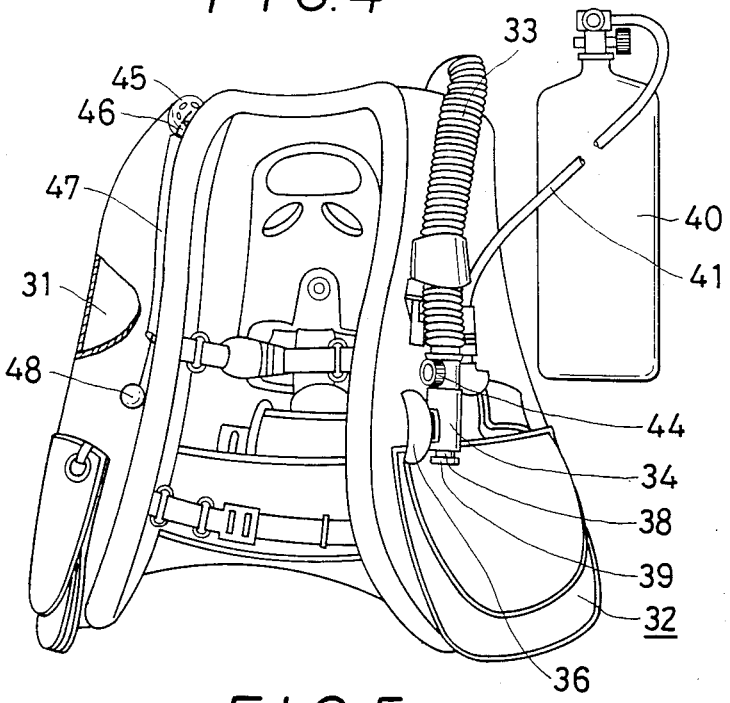
FIG. 4 is a perspective view of the conventional buoyant force control apparatus for scuba diving, a part of the apparatus being broken away.
Figure 5:
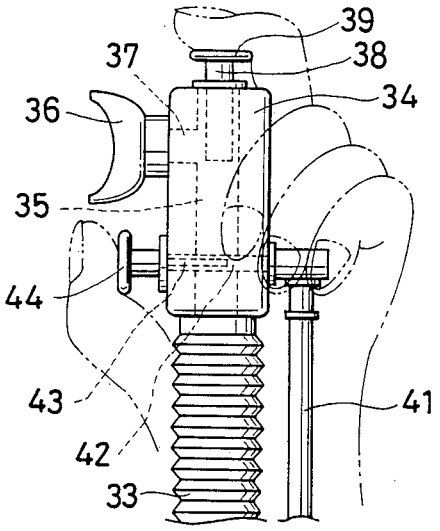
FIG. 5 is an enlarged front view of a manual operation of the valve box connected to the lower end of the oral inflator hose in the conventional buoyant force control apparatus for scuba diving.

As shown in FIGS. 2 and 3, the air supply valve 4 has a valve seat 7 formed on an inner circumferential wall face of the tubular cylinder 6 made of rigid synthetic resins, an air breathe-in port 8 held in the mouth to supply air situated at the bottom portion of the air supply valve 4 and made of a rigid synthetic resin, and a communication port 11 formed in the upper peripheral wall of a valve shaft 10 provided with an air breathe-in tube passage 9 led to the port 8. The communication port 11 is communicated with the air supply tube passage 5. A valve head 12 is formed on the upper edge of the valve shaft 10 and an O ring 13 is situated between a bottom face of the valve head 12 and the valve seat 7 and firmly contacts with the seat 7 in order to close the air supply tube passage 5 and place the valve head 12 at the place above the valve seat 7. The valve shaft 10 is loosely inserted into the tubular cylinder 6 and a valve spring 15 is placed around the outer circumferential face of the valve shaft 10 between the valve seat 7 and an enlarged portion 14 formed on the outer peripheral face of the valve shaft 10 at the position near the middle thereof. A brim 16 is formed so as to contact with the lower end face of the tubular cylinder 6 and to stop an excessive upward movement of the tubular cylinder 6.

An upper portion of the tubular cylinder 6 of the air supply valve 4 is inserted in the bottom opening of the air supply tube passage 5 of the air supply rubber tube 3 and secured there.

When the user of the buoyant force control apparatus according to the present invention holds the air breathe-in port 8 of the air supply valve 4 between teeth and he pushes upward the valve shaft 10 against a function of the valve spring 15, the valve shaft 10 is raised as shown in FIG. 2 and the brim 16 hits the bottom edge of the tubular cylinder 6 in order to release a close-contact condition of the O ring 13 to the valve seat 7. In consequence, air flown in through the air breathe-in port 8 is sent or supplied to the air chamber 1 along the direction of arrows shown in FIG. 2 through the breathe-in tube passage 9, the communication port 11, a gap between the inner circumferential wall face of the tubular cylinder 6 and the O ring 13, and the air supply tube passage 5 of the air supply rubber tube 3.

After a predetermined volume of air is supplied to the air chamber 1, the mouth comes apart from the breathe-in port 8 and simultaneously an upward pressing condition of the valve shaft 10 is released, so that the valve spring 15 functions elastically to down the valve shaft 10 and the O ring 13 is urged to the valve seat 7 so as to close the air supply tube passage 5 to the air supply rubber tube 3, preventing air in the air chamber 1 from backward flowing.

At the position of either front half of the wear 2, the air supply valve 17 is attached, the position is convenient to the user to easily manipulate it, so as to communicate with the air chamber 1. To an air supply tube passage (not shown) of the air supply valve 17, a lower end of the middle-pressure hose 19 is communicated with and fixed, an upper end of the middle-pressure hose 19 being fixed to the air tank 18. Any opening and closing means 20 of, for example, a push-button type for opening a valve passage when the button is pushed or a slide type for opening the valve passage when the slide plate 17*a* shown is pushed in parallel to the surface of the front half can be used to the air supply valve 17.

Around the shoulder above the attachment portion of the air supply rubber tube 3 of the wear 2, a first air exhaust valve 21 is attached and communicated with the air chamber 1. The first air exhaust valve 21 has a pull string 22 for opening and closing the valve, the pull string 22 being situated and secured so as to place its grip ball 23 at the lower end of the string 22 above the fix position of the air supply rubber tube 3.

It is noted that the air supply rubber tube 3 and the first exhaust valve 21 are placed at the same side or the same front half of the vest 2, so that it is necessary to have them at two different positions of different heights in order to prevent the user or diver from erroneously maniplating them.

While, at the shoulder portion opposing to the first exhaust valve 21 of the wear 2, the second exhaust valve 24 communicates with the air chamber 1 and is secured there. A pull string 25 for releasing the second exhaust valve 24 has a middle portion extending downward through a guide tube 26 attached to the wear 2 and a grip ball 27 at its lower end.

An operating method of the buoyant force control apparatus for scuba diving of the present invention will be explained with reference to the accompanying drawings.

When the diver or user of the apparatus wants to supply air to the air chamber 1 in the wear 2 so as to control buoyant force of his vest, an opening and closing means 20, such as, for example, the slide plate 17*a* and etc. is operated to open the air supply tube passage of the air supply valve 17 in order to supply air contained in the air chamber 18 to the air chamber 1 through the middle-pressure hose 19. When a predetermined volume of air is supplied, the driver operates the opening and closing means 20, such as the slide plate 17*a* to stop the air supply, as well as shut off the air supply tube passage preventing air from reverse-flowing and from flowing-out of the vest 2. Alternately, the valve shaft 10 of the air supply valve 4 fixed on the lower end of the air supply rubber tube 3 is pushed upwardly in order to make the valve head 12 spaced apart from the valve seat 7. Then, the user holds the air breathe-in port 8 between teeth and supplys a predetermined volume of air. As soon as possible to release the air breathe-in port 8 from his mouth, an upward compressed condition of the valve shaft 10 is released, then the valve spring 15 elastically returns to its natural position and the valve shaft 10 is pushed down. In consequence, the O ring 13 is compressed to the valve seat 7 to close the air supply tube passage 5 preventing air in the air chamber 1 from reversely flowing and stopping any flowing-out of air from the air chamber 1.

On the contrary, in order to exhaust air from the air chamber 1, it is necessary to grip and pull down either grip ball 23 or 27 of either pull string 22 or 25 for the first or second exhaust valves 21 and 24 in order to release one of the exhaust valves 21 and 24. Thus, a predetermined volume of air is exhausted, and when the grip ball 23 or 27 is released, the exhaust valve 21 or 24 released is closed stopping flowing-out of air from the air chamber.

According to the buoyant force control apparatus of the present invention, air supply can be carried out as stated above by holding the air breathe-in port 8 in the mouth of the diver while the air supply valve opening and closing means is being manipulated or the valve shaft of the air supply valve is being pushed by his or her fingers and breathing-in air into the port 8. Air exhaustion can be done as stated above by pulling-down one of pull strings 22 and 25 of either exhaust valve.

Differing from the conventional buoyant force control apparatus in which air supply and air exhaustion are carried out by pressing-operation of plural buttons using one single hand of the diver, the operations of air supply and air exhaustion are done according to the basic operations or manipulations differed completely from each other in the present invention. In consequence, even beginners cannot erroneously manipulate the control apparatus of the present invention, increasing safety of the diving appliance. According to the conventional control apparatus of such kind, two buttons of air supply and air exhaustion are attached operatively to the lower end of the oral inflator hose, however, in the present invention, the push button of an air supply valve is fixed to the front face of the wear, preventing the push button from being missed even while diving under water and attaining effective and right operation of the push button.

In addition, the control apparatus of the present invention doesn't have a large diameter oral inflator hose and a valve box, so that it is possible to eliminate much hosing on and around the diver's suit and to simplify or clear the front portion of the wear, leading to safety of the diver's life. It is possible to make the size or bulk of the bag containing the diving appliance small, making handling of the bag extraordinarily easy.

What is claimed is:

1. A buoyant force control apparatus for scuba diving, which comprises a wear having an inner air chamber, an air supply rubber tube, an upper opening of which tube being communicated with and secured to a half portion of the front face of said wear, an air supply valve inserted into and secured to a lower opening of said air supply rubber tube, said air supply valve having a valve shaft provided with a communication port communicated to an air breathe-in port, an air breathe-in tube passage and an air supply tube passage of said air supply rubber tube, an air supply valve situated at a position a little below the half portion of the front face of the wear, said air supply valve having an opening and closing means adapted to be opened and closed by a pushing manipulation and communicating with said air chamber and being secured there, a middle-pressure hose having an upper end connected to (an air supply tank) and a lower end connected to the air supply tube passage of said air supply valve and secured thereto, and a first and a second exhaust valves, respectively, having pull strings for opening and closing valves and grip balls, said first and the second exhaust valves being attached to around both shoulders of said wear so as to communicate with the air chamber and be secured there.

2. The buoyant force control apparatus for scuba diving according to claim 1, wherein said air supply valve is of a push button type and a pushing operation of the push button releases the valve passage.

3. The buoyant force control apparatus for scuba diving according to claim 1, wherein said air supply valve is of a slide type and a sliding operation of a slide plate releases the valve passage.

* * * * *